US006592398B2

(12) United States Patent
Kashiyama et al.

(10) Patent No.: US 6,592,398 B2
(45) Date of Patent: Jul. 15, 2003

(54) COUPLING DETECTOR FOR CONNECTOR

(75) Inventors: Motohisa Kashiyama, Shizuoka (JP); Toshiyuki Yamaguchi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/115,131

(22) Filed: Apr. 4, 2002

(65) Prior Publication Data

US 2003/0060078 A1 Mar. 27, 2003

(30) Foreign Application Priority Data

Apr. 4, 2001 (JP) ..... 2001-106184

(51) Int. Cl.[7] ..... H01R 3/00
(52) U.S. Cl. ..... 439/489; 439/188; 439/315
(58) Field of Search ..... 439/488, 489, 439/315, 188

(56) References Cited

U.S. PATENT DOCUMENTS 5,277,608 A * 1/1994 Oda ..... 439/188
5,647,754 A * 7/1997 Kohno ..... 439/489
5,775,936 A * 7/1998 Tsuji ..... 439/489
5,913,703 A * 6/1999 Suzuki et al. ..... 439/489
6,386,898 B1 * 5/2002 Taguchi ..... 439/489

* cited by examiner

*Primary Examiner*—P. Austin Bradley
*Assistant Examiner*—Briggitte Hammond
(74) *Attorney, Agent, or Firm*—Sughrue Mion, PLLC

(57) ABSTRACT

A conductive member is provided in a first connector together with a plurality of terminal fittings. The conductive member includes elastic arms associated with the respective terminal fittings. Each elastic arm is divided into a first conductive piece and a second conductive piece which are moved together. The first conductive piece is brought into contact with the terminal fitting when the first connector and the second connector are disengaged. The second conductive piece is away from the terminal fitting when the first connector and the second connector are disengaged. Insulative members are provided in the second connector so as to be associated with the respective elastic arms. Each insulative member includes a first insulative piece and a second insulative piece. The first insulative piece is inserted between the terminal fitting and the first conductive piece when the first connector and the second connector are engaged. The second insulative piece moves the second conductive piece in a direction away from the terminal fitting when the first connector and the second connector are engaged.

1 Claim, 21 Drawing Sheets

COUPLING DETECTOR FOR CONNECTOR

BACKGROUND OF THE INVENTION

The present invention relates to a coupling detector for a connector for detecting whether the connector to be employed for electric connection of wire harnesses etc. installed in motor vehicles are properly coupled or not.

Especially in the connector to be employed in a wiring system for an air bag or the like in a motor vehicle, for example, it is necessary to strictly check whether the connector has been completely coupled or not.

For this purpose, there have been conventionally proposed various types of connectors, such as a connector in which coupling can be mechanically detected from a state of movement of a slider, a connector in which coupling can be electrically detected, and a connector provided with these two functions.

Among them, the connector as described below has been known as the connector of the type in which coupling can be electrically detected.

In FIG. 21, a connector 101 capable of electrically detecting the coupling includes a male connector 102 and a female connector 103. The male connector 102 has a male connector housing 104 made of synthetic resin, a pair of female terminals 105 (only one is shown in the drawing), and a short-circuiting metal piece 106 adapted to short-circuit the pair of the female terminals 105. There is formed inside the male connector housing 104, a chamber 107 for the pair of the female terminals 105 and the short-circuiting metal piece 106. There is also formed outside the male connector housing 104, a locking arm 109 having a locking projection 108. Electric wires 110 are press-fitted to the female terminals 105, and the short-circuiting metal piece 106 is formed with an elastic arm 111.

The female connector 103 has a female connector housing 112, a pair of male terminals 113 (see FIG. 22). There are formed inside the female connector housing 112, a chamber 114 for the pair of the male terminals 113, and a connector engaging room 116 for the male connector 102. There are formed in the connector engaging room 115, a partition wall 116 existing between the pair of the male terminals 113, an insulating piece 117 integrally formed with the partition wall 116, and a locking hole 118 for engagement with the above described locking projection 108. The insulating piece 117 is formed so as to correspond to a contact position between the female terminals 105 and the elastic arm 111 of the male connector 102. The male terminals 113 are arranged in such a manner that their distal ends may project into the connector engaging room 115. Electric wires 119 are press-fitted to backward ends of the male terminals 113.

In an initial state of the coupling as shown in FIG. 23, the elastic arm 111 is in contact with the female terminals 105 of the male connector 102 (see FIG. 21) to establish a short circuit between the female terminals 105. When the female connector 103 is moved from this state in a direction of an arrow to initiate the coupling, the male terminals 113 are inserted into the female terminals 105 as shown in FIG. 24, and at the same time, the insulating piece 117 slides along contact faces of the female terminals 105 with respect to the elastic arm 111 (a state on the way of the coupling). Then, as shown in FIG. 25, as the female connector 103 further continues to move and the coupling of the connector 101 has been completed, the insulating piece 117 pushes up the elastic arm 111 to cancel the short circuit between the female terminals 105, needless to say that the electrical connection between the male terminals 113 and the female terminals 105 has been completed.

Therefore, by electrically detecting that the short circuit has been canceled, the state of the coupling in the connector 101 can be confirmed.

By the way, in the above described configuration, there has been such a problem that when the male connector 102 and the female connector 103 are coupled, the insulating piece 117 may be deformed or broken by diagonal or forcible insertion. Cancellation of the short circuit may not be reliably conducted, resulting in damage in reliability of electrical detection of the coupling.

SUMMARY OF THE INVENTION

It is therefore an object of the invention is to provide a coupling detector for a connector in which cancellation of a short circuit can be reliably conducted, and reliability of electrical detection of the coupling can be enhanced.

In order to achieve the above object, according to the present invention, there is provided a coupling detector for electrically detecting whether a first connector and a second connector are plenarily coupled with each other, comprising:

a conductive member provided in the first connector together with a plurality of terminal fittings, the conductive member including elastic arms associated with the respective terminal fittings, each elastic arm being divided into a first conductive piece and a second conductive piece which are moved together, the first conductive piece brought into contact with the terminal fitting when the first connector and the second connector are disengaged, the second conductive piece being away from the terminal fitting when the first connector and the second connector are disengaged; and insulative members provided in the second connector so as to be associated with the respective elastic arms, each insulative member including a first insulative piece and a second insulative piece, the first insulative piece inserted between the terminal fitting and the first conductive piece when the first connector and the second connector are engaged, the second insulative piece moving the second conductive piece in a direction away from the terminal fitting when the first connector and the second connector are engaged.

In this coupling detector, even though one of the first and the second insulative pieces is deformed or broken, the other one acts on the associated conductive piece to cancel the short circuit.

Therefore, the short circuit can be reliably canceled so that reliability of electrical detection of the coupling is enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Now, one preferred embodiment of the present invention will be described referring to the accompanying drawings.

Figure 1:
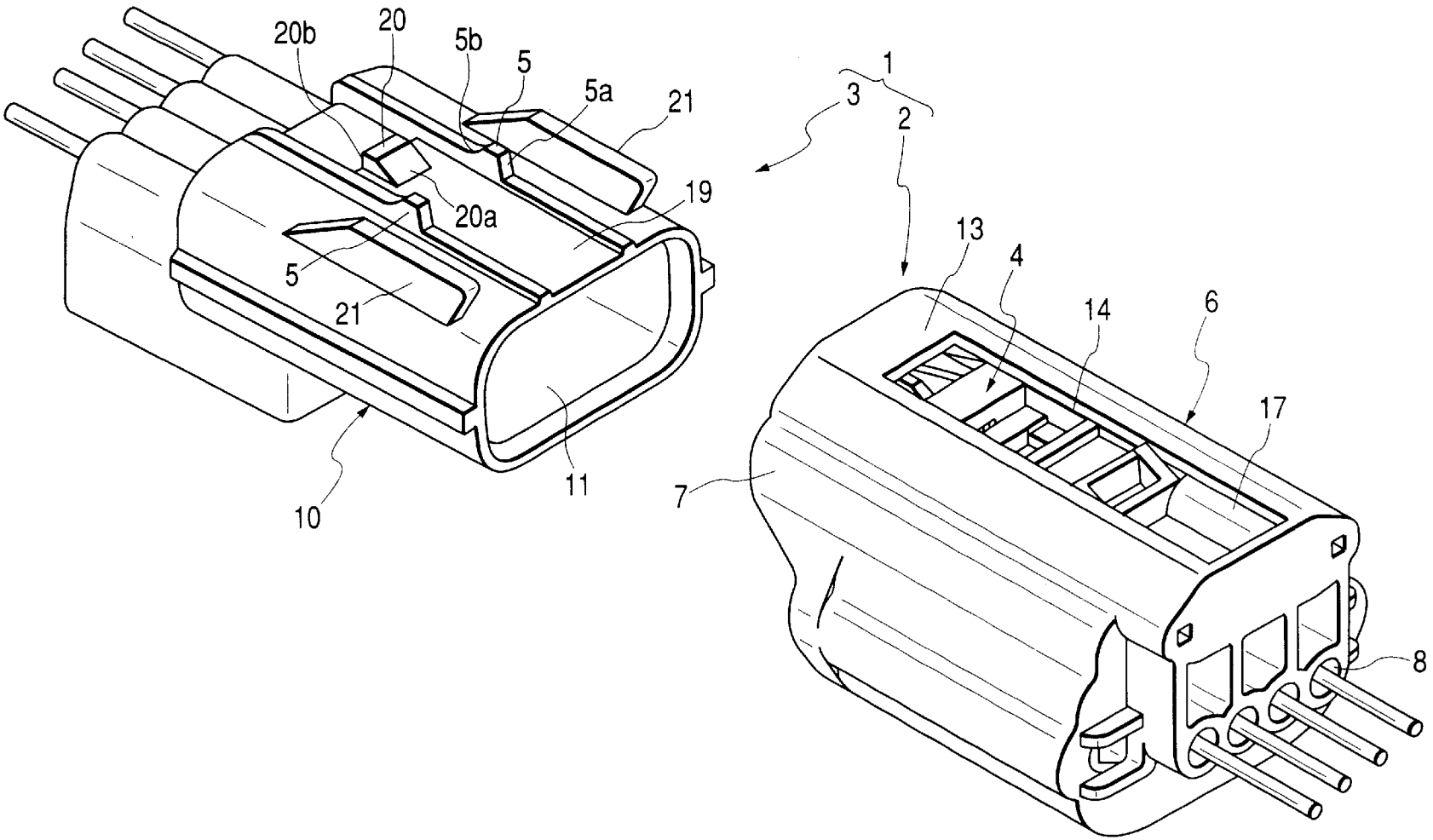
FIG. 1 is a perspective view showing an outer appearance of a connector provided with a coupling detector according to one embodiment of the present invention.

In FIG. 1, a connector 1 to be employed in a wiring system for an air bag or the like in a motor vehicle, for example, includes a male connector 2 having a slider 4 made of synthetic resin and acting as a mechanical coupling detector, and a female connector 3 having a pair of abutting projections 5 adapted to be pressed by the slider 4.

Figure 3:
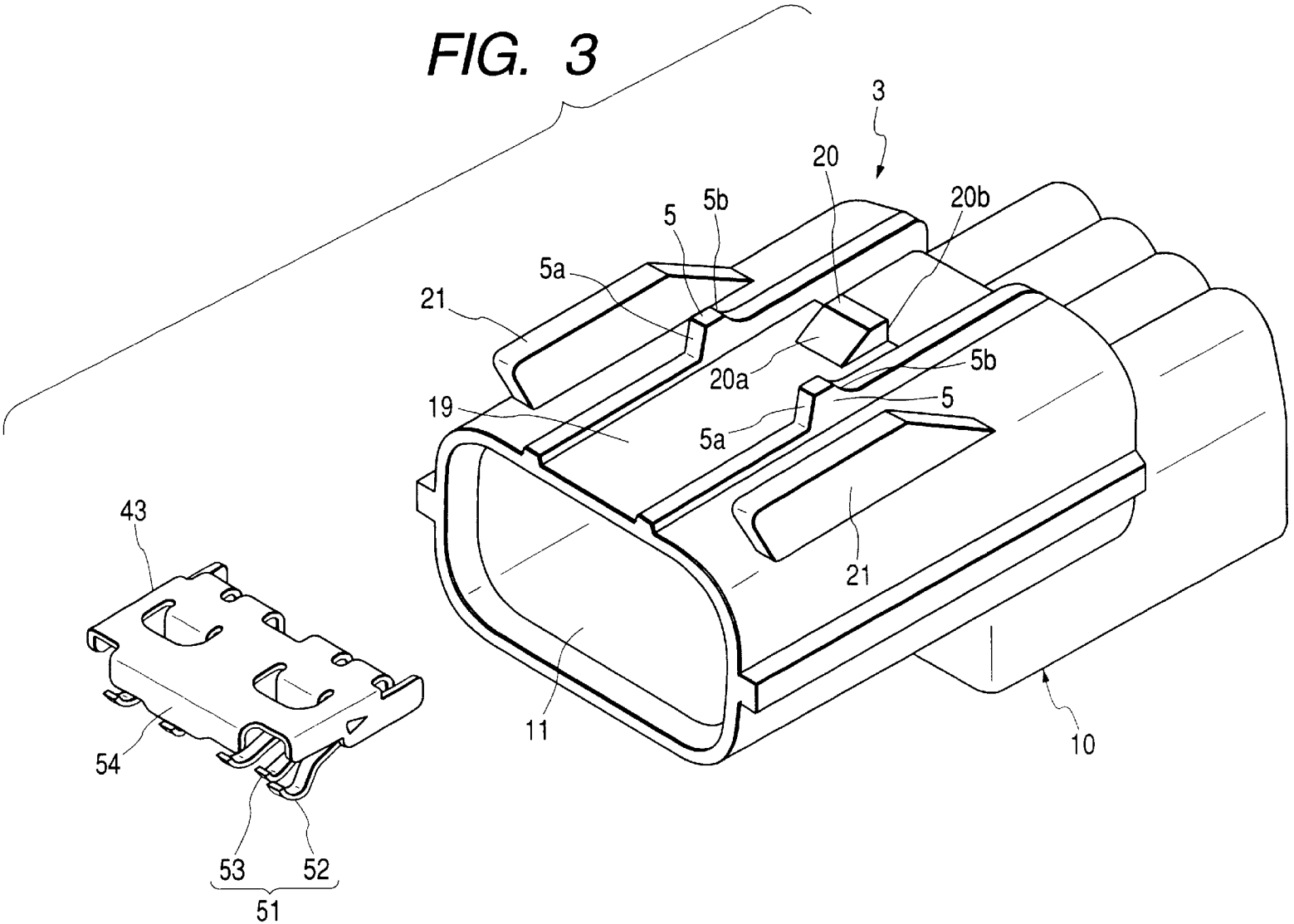
FIG. 3 is an exploded perspective view of a female connector.

The male connector 2 includes a male connector housing 6 made of synthetic resin and having a hood portion 7, and a plurality of female terminals 9 (see FIG. 4) inserted and locked in a plurality of terminal chambers 8 in the male connector housing 6. The female connector 3 includes a female connector housing 10 made of synthetic resin and having a connector engaging room 11, a plurality of male terminals 12 (see FIG. 4) inserted from a back of the female connector housing 10 and locked, and a short-circuiting metal piece 43 (see FIG. 3) for establishing a short circuit between the male terminals 12 as an electrical coupling detector. The male connector housing 6 is further provided with an insulating piece 47 (see FIG. 4) which is the counterpart of the electrical coupling detector.

To describe more specifically, a rectangular opening 14 is formed in an upper wall 13 of the hood portion 7 of the male connector 2. The slider 4 is inserted into an inner space 15 (see FIG. 2) of the opening 14 from a front opening 16 (see FIG. 4) so as to slide in a longitudinal direction thereof. Further, a pair of spring holders 17 (see FIG. 5) are formed on both sides of a backward end of the opening 14. Helical compression springs (resilient members) 18 (see FIG. 2) are respectively mounted to the spring holders 17 through the front opening 16 (see FIG. 4).

On the other hand, in the female connector housing 10, there are formed the above described pair of the abutting projections 5 in parallel, at an intermediate position in a longitudinal direction of its upper wall 19. Further, a lock projection 20 for the male connector 2 is provided behind the abutting projections 5, at a center part in a lateral direction of the upper wall 19. Each of the abutting projections 5 is provided with a vertical abutting face 5*a* on its forward side and an inclined face 5*b* on its backward side. The lock projection 20 is provided with an inclined face 20*a* on its forward side and a vertical locking face 20*b* on its backward side. Guide ribs 21 for positioning the male connector 2 are respectively provided outside of the abutting projections 5 in a lateral direction.

Figure 2:
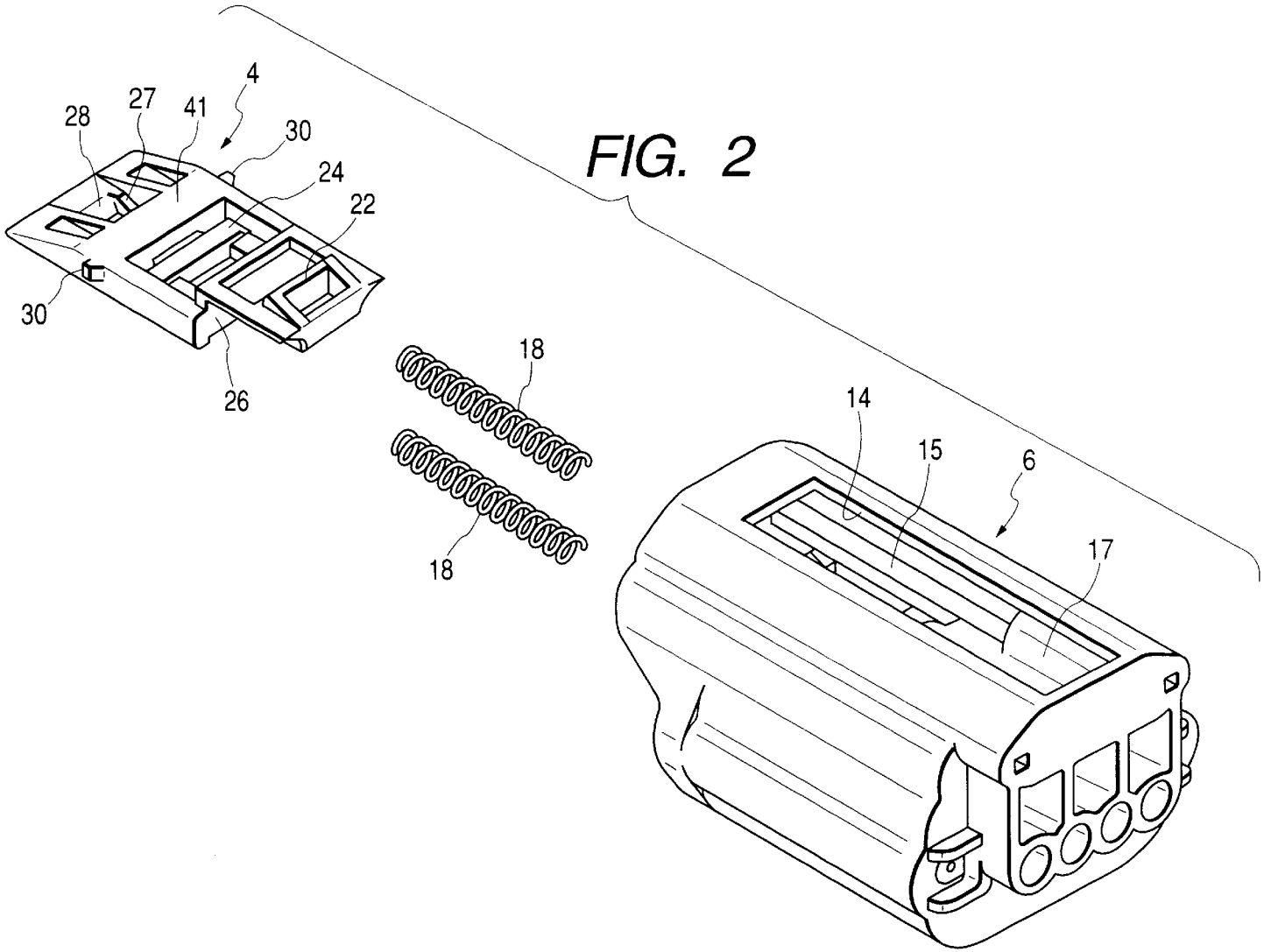
FIG. 2 is an exploded perspective view of a male connector.

Referring to FIG. 2, the slider 4 has an upwardly directed protrusion 22 for retreating operation on its backward side, and a stop projection 23 (see FIG. 4) formed on a lower side of the protrusion 22. The slider 4 also has, at its intermediate area, a C-shaped flexible abutting arm 24. On both sides of a front end of the abutting arm 24, there are provided downwardly directed abutting projections 25 (see FIG. 4). A base end of the abutting arm 24 is located inside a rear step 26, and forward ends of the helical springs 18 are adapted to be abutted against the rear step 26.

A pair of first guide slopes 27 (see FIG. 4) are formed on a forward side of the slider 4. Further, a second guide slope 28 is formed inside and forward of the pair of the first guide slopes 27. Both the guide slopes 27, 28 are inclined downwardly in a backward direction. An angle of inclination of the second guide slope 28 is larger than that of the first guide slopes 27.

Figure 4:
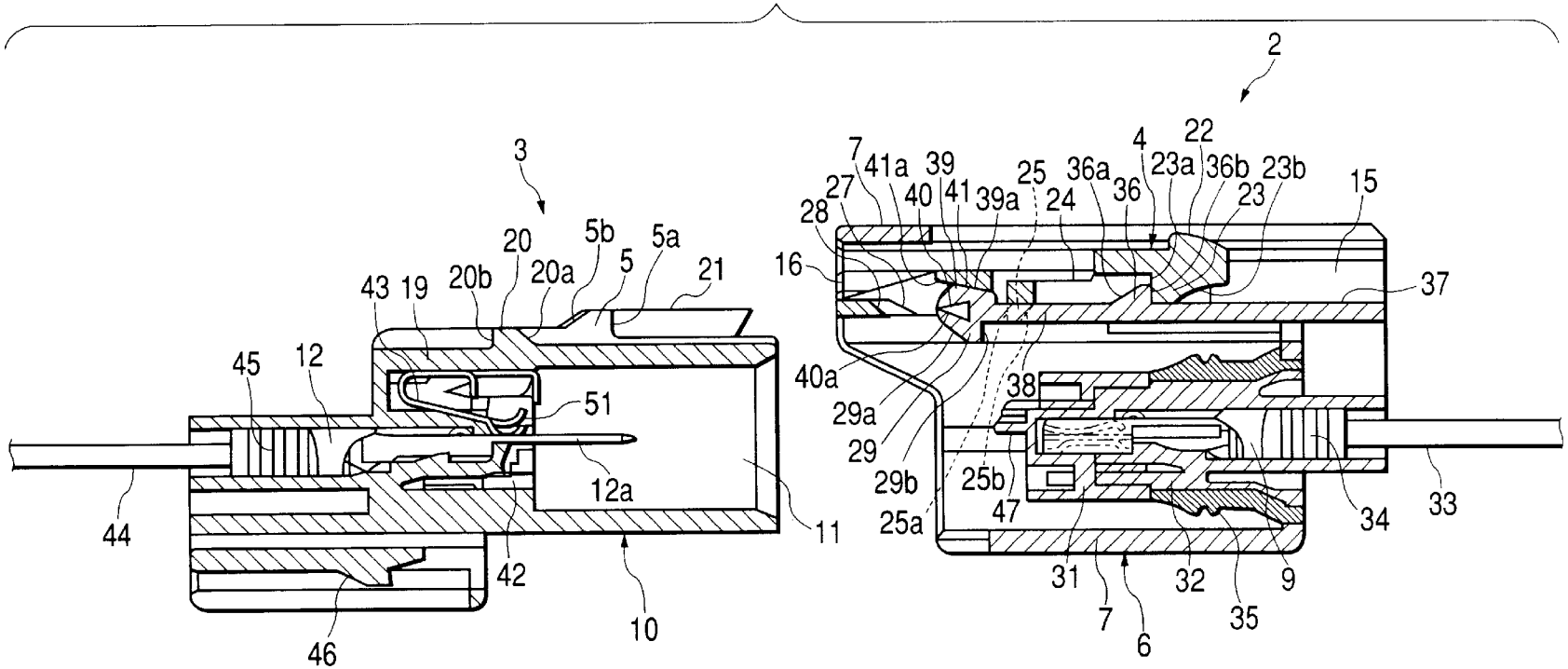
FIG. 4 is a sectional view of the connector.

On the other hand, there are formed on a lower face of the slider 4, a pair of guide grooves (not shown) extending from its forward end to the above described abutting projections 25 (see FIG. 4). The abutting projections 5 of the female connector housing 10 are adapted to enter into these guide grooves. There are further provided stop projections 30 for preventing a forward withdrawal, on both sides of the intermediate area of the slider 4.

As shown in FIG. 4, the lock projection 20 of the female connector housing 10 is formed so as to be opposed to a downwardly directed lock projection 29 of the male connector housing 6.

The male connector 2 has an inner housing 32 provided with a front holder 31, in a lower part inside the hood portion 7. There are locked, inside the inner housing 32, the aforesaid female terminals 9 provided with electric wires 33. Waterproof rubber plugs 34 are inserted over the electric wires 33, and a gasket 35 is mounted around the inner housing 32. There is also provided in an upper part inside the hood portion 7, the slider 4 so as to slide in a longitudinal direction (in an engaging/disengaging direction of the connector).

The slider 4 is urged in a forward direction (in an engaging direction of the connector) by the helical springs 18 (see FIG. 2). The stop projection 23 is formed with a vertical abutting face 23*a* on its forward side and an inclined face 23*b* on its backward side. The inclined face 23*b* is formed for the purpose of smoothly riding over the stop and guide projection 36 which belongs to the hood portion 7, when the slider 4 is mounted to the hood portion 7. The guide projection 36 is provided so as to be directed upwardly, at an intermediate position in a longitudinal direction of a horizontal intermediate wall 37 in the hood portion 7, and formed with an inclined face 36*a* on its forward side and an abutting face 36*b* on its backward side. The above described inner space 15 is provided above the intermediate wall 37. Moreover, a forward half of the intermediate wall 37 is largely cut out, and inside the cutout portion, there is provided a flexible lock arm 38 (see FIG. 6) integrally formed with the intermediate wall 37 and extending forwardly.

The lock arm 38 has a downwardly directed lock projection 29 and an upwardly directed abutting projection 39 at its distal end portion. The lock arm 38 also has a pair of contact projections 40 for unlocking the lock, on both sides of its distal end portion. The lock projection 29 is formed with an inclined face 29*a* on its forward side, and a locking face 29*b* which is vertical or slightly inclined forwardly, on its backward side. The abutting projection 39 is formed with a backwardly and downwardly inclined face 39*a* on its upper face. Each of the contact projections 40 is formed with a forwardly and upwardly inclined face 40*a* on its lower face. The distal end portion of the lock arm 38 is adapted to be located at substantially half way between a forward end of the hood portion 7 and a forward end of the inner housing 32.

There is formed an abutting wall 41 in a forward area of the abutting arm 24 of the slider 4. There are further formed, forward of the abutting wall 41, the aforesaid first guide slopes 27, and still forward of the first guide slopes 27, the aforesaid second guide slope 28. Each of the abutting projections 25 of the slider 4 is formed with a vertical abutting face 25*a* on its forward side and an inclined face 25*b* on its backward side.

In a state where the stop projection 23 is abutted against the guide projection 36, the abutting projections 25 are positioned in the rear of the lock projection 29 on both sides of the lock arm 38. Lower ends of the abutting projections 25 are made flush with a lower face of the lock arm 38. On one hand, the abutting wall 41 is formed substantially in a wedge-like shape in cross section having on its lower face a backwardly and downwardly inclined face 41*a* which is adapted to come into contact with the abutting projection 39 of the lock arm 38. On the other hand, the first guide slopes 27 are positioned in an opposed relation to a forward part of the contact projections 40 of the lock arm 38, while the second guide slope 28 is positioned diagonally upward of the locking projection 29 in an opposed relation to the forward end of the lock arm 38.

Figure 5:
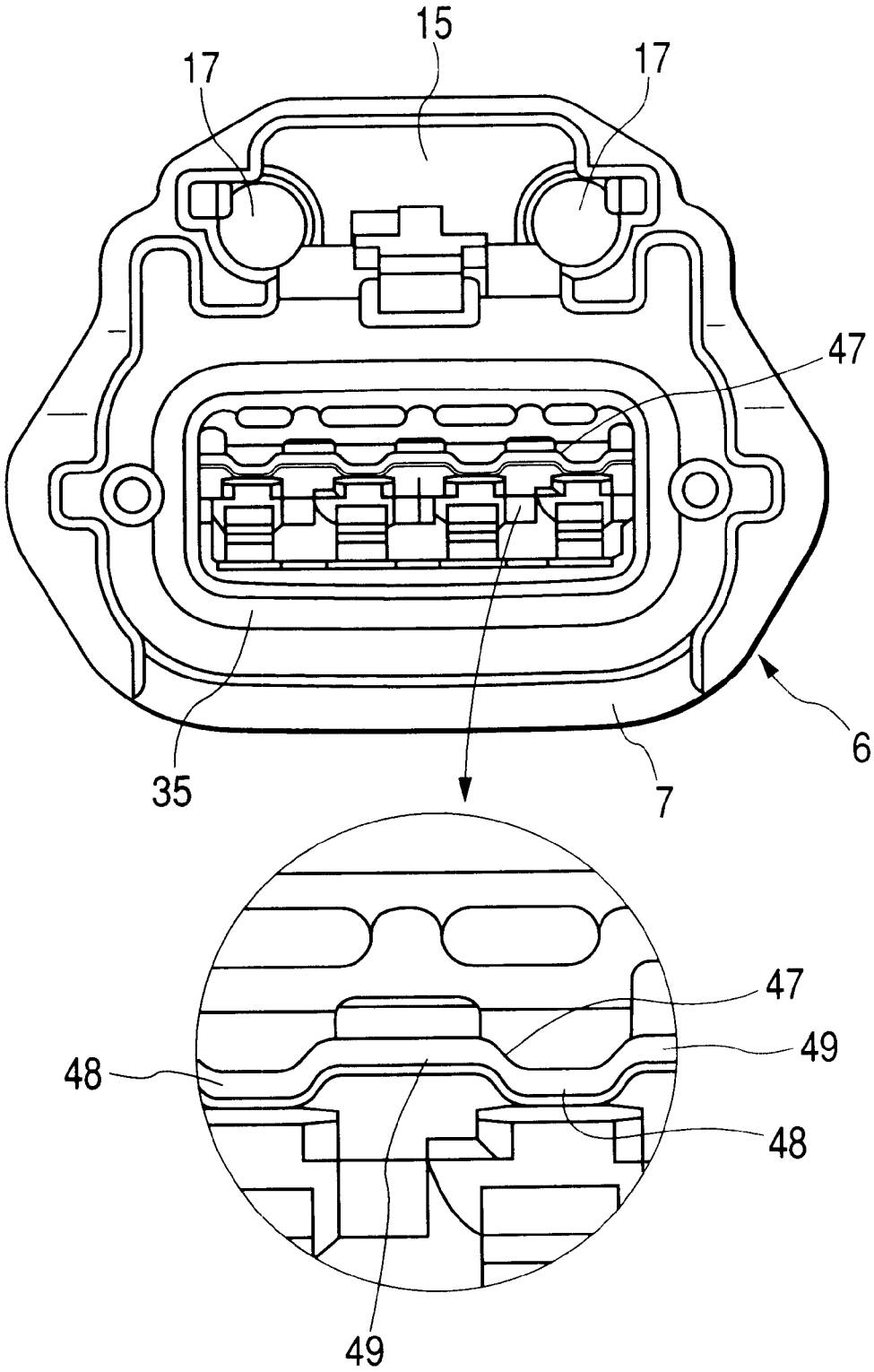
FIG. 5 is a front view of a male connector housing (encircled is an enlarged view of an essential part)
Figure 6:
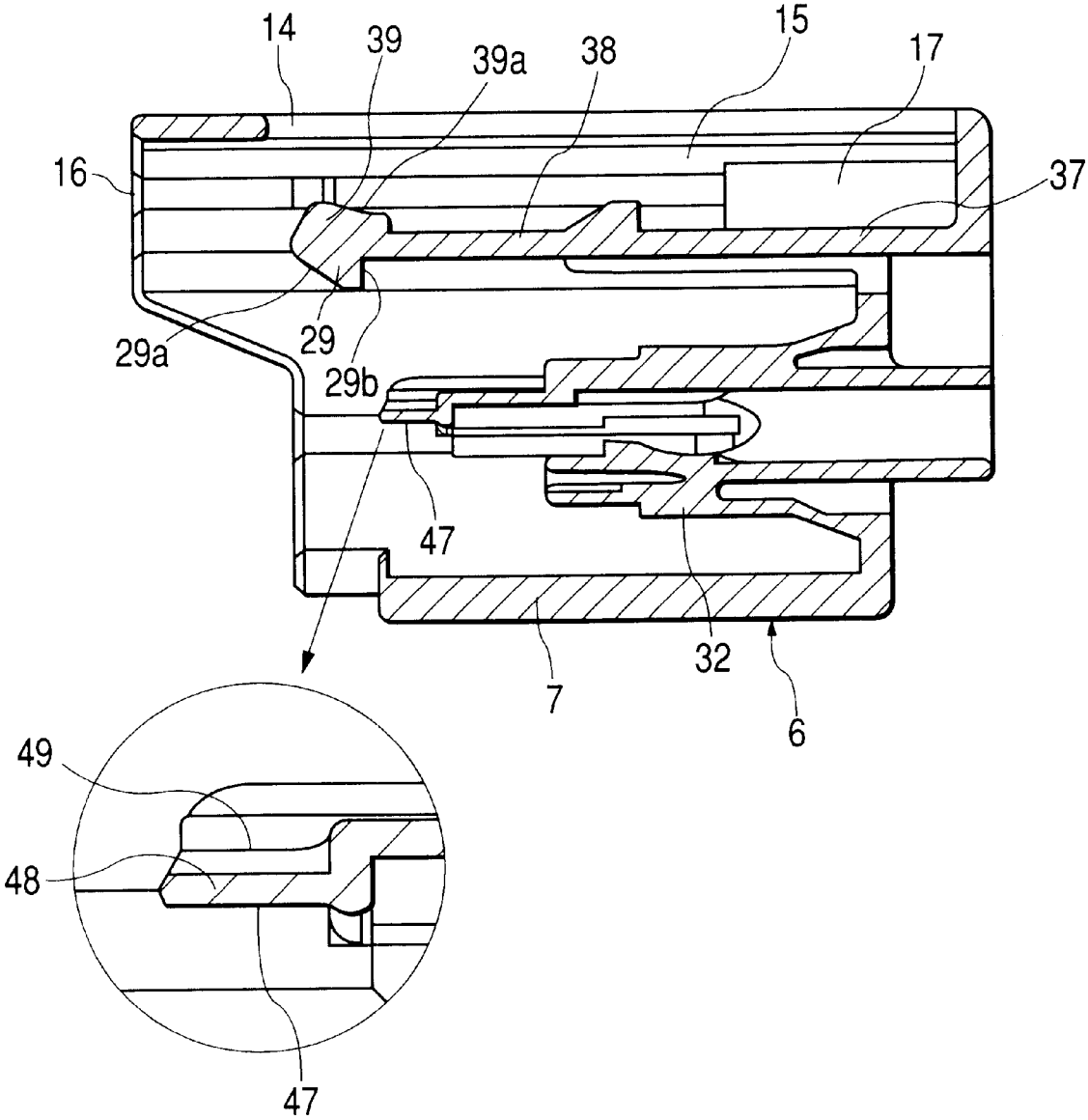
FIG. 6 is a sectional view of the male connector housing (encircled is an enlarged view of the essential part)

The insulating piece 47 of the male connector housing 6 is formed as a portion for canceling the short circuit between the male terminals 12 which have been established by the short-circuiting metal piece 43, as shown in FIGS. 5 and 6. Moreover, the insulating piece 47 is formed in two steps consisting of a short circuit canceller 48 at a lower position and an auxiliary canceller 49 at an upper position. The steps are provided in a plurality of rows corresponding to steps of the short-circuiting metal piece 43 (see FIG. 4) which will be described below.

Referring back to FIG. 4, backward half portions of the male terminals 12 are respectively contained in the terminal chambers which are defined by front holders 42 of the female connector housing 10. A tab portion 12*a* of each of the terminals 12 in its forward half is arranged so as to project into the connector engaging room 11. The terminals 12 are short-circuited by the conductive short-circuiting metal piece 43. Waterproof rubber plugs 45 are respectively inserted over electrical wires 44 which are press-fitted to the terminals 12. The female connector housing 10 is adapted to be fixed to a vehicle body, equipment or the like (not shown) by a fixed arm 46 provided in its lower part.

Figure 7:
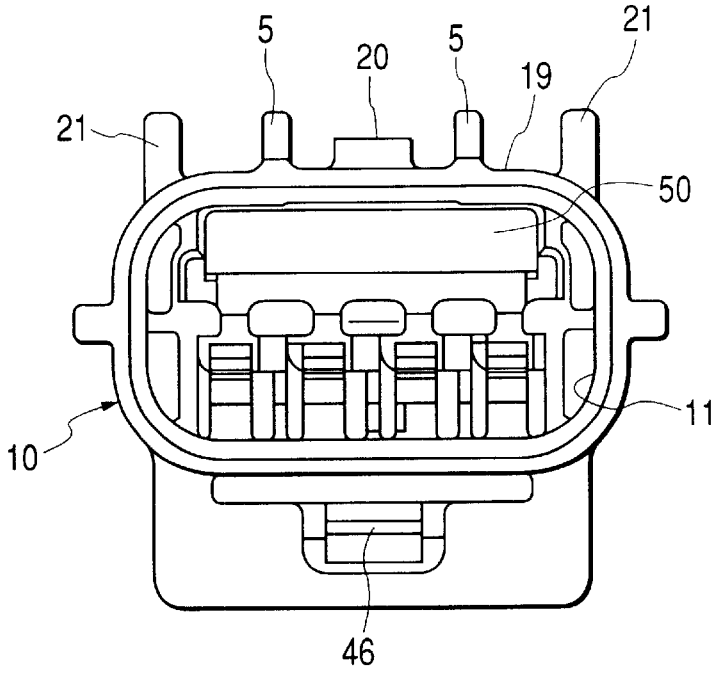
FIG. 7 is a front view of a female connector housing.
Figure 8:
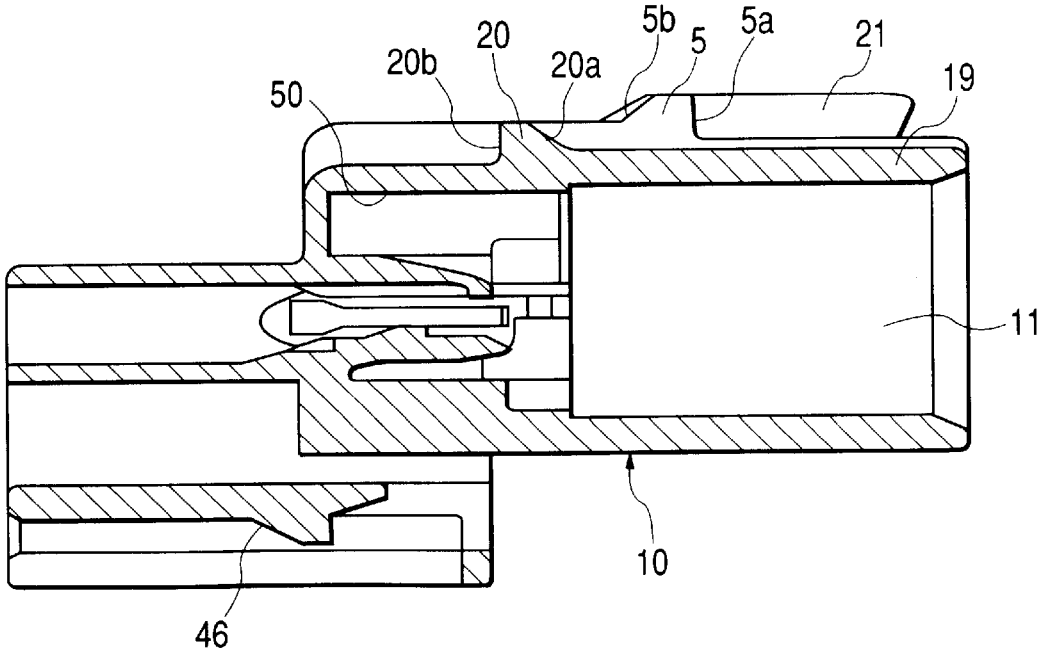
FIG. 8 is a sectional view of the female connector housing.
Figure 9A:
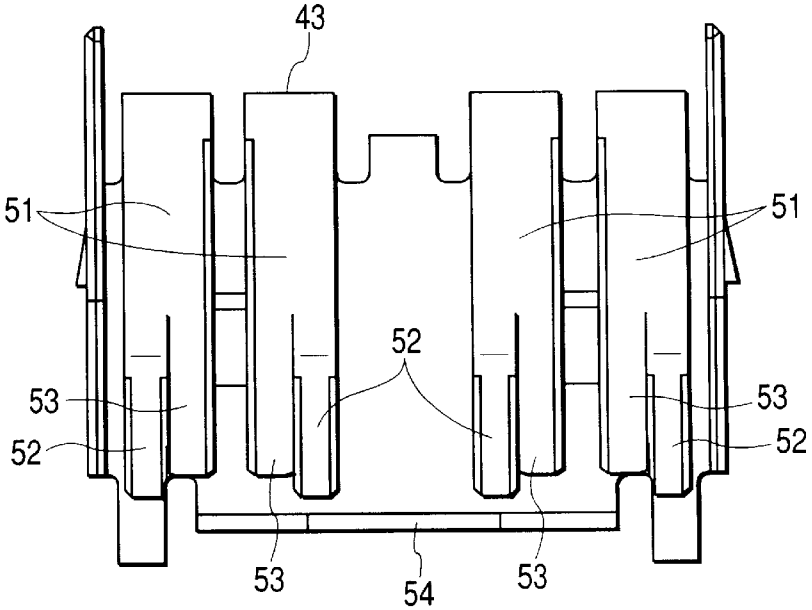
FIG. 9A is a plan view showing a short-circuiting metal piece.
Figure 9B:
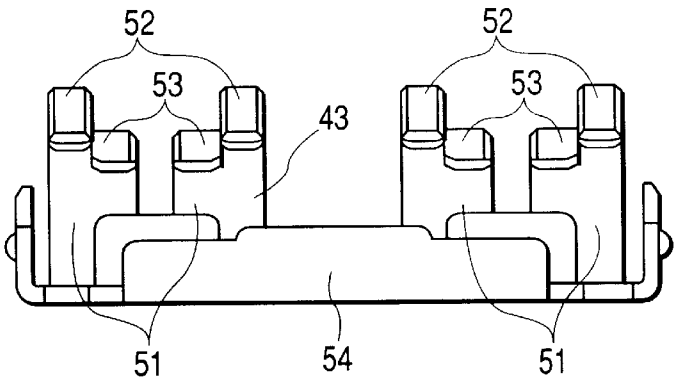
FIG. 9B is a front view showing the short-circuiting metal piece.
Figure 9C:
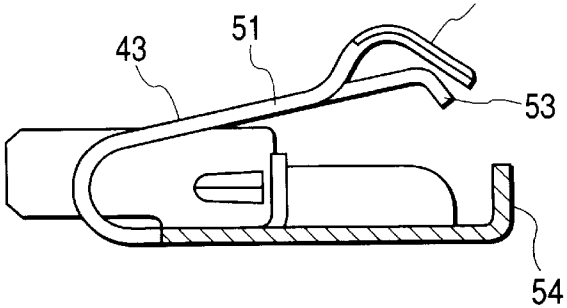
FIG. 9C is a sectional view showing the short-circuiting metal piece.
Figure 10:
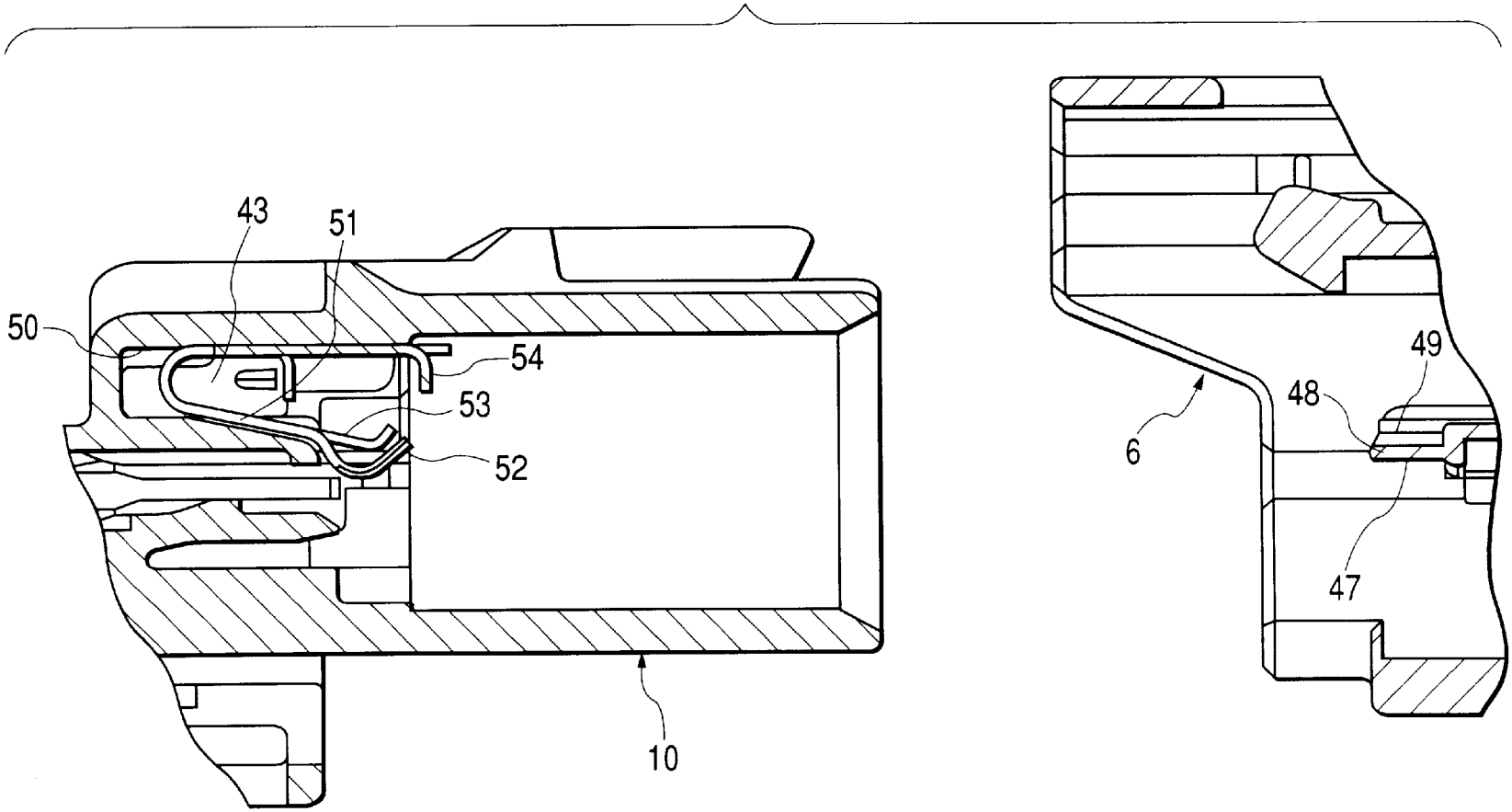
FIG. 10 is an enlarged sectional view of the male connector housing and the female connector housing provided with the short-circuiting metal piece.

The short-circuiting metal piece 43 is contained in a chamber 50 (see FIGS. 7 and 8) which is formed in the female connector housing 10. As shown in FIGS. 9A through 9C, the short-circuiting metal piece 43 includes a plurality of elastic arms 51. These elastic arms 51 are arranged so as to correspond to the male terminals 12 (see FIG. 4). Each of the elastic arms 51 is divided into a short-circuiting piece 52 and an auxiliary piece 53 at its distal end, adapted to move together, which are respectively formed in a substantially V-shape. The short-circuiting piece 52 is formed so as to be positioned at a lower position than the auxiliary piece 53 (see FIG. 10). Reference numeral 54 designates a push-in wall to be used when the short-circuiting metal piece 43 is received in the chamber 50 (see FIGS. 7 and 8), Distal ends of the short-circuiting piece 52 and the auxiliary piece 53 are positioned inward of the push-in wall 54 so as to be protected when the short-circuiting metal piece 43 is received.

In the above described structure, operation of the above described connector 1 will be explained referring to FIGS. 11 to 20.

Figure 11A:
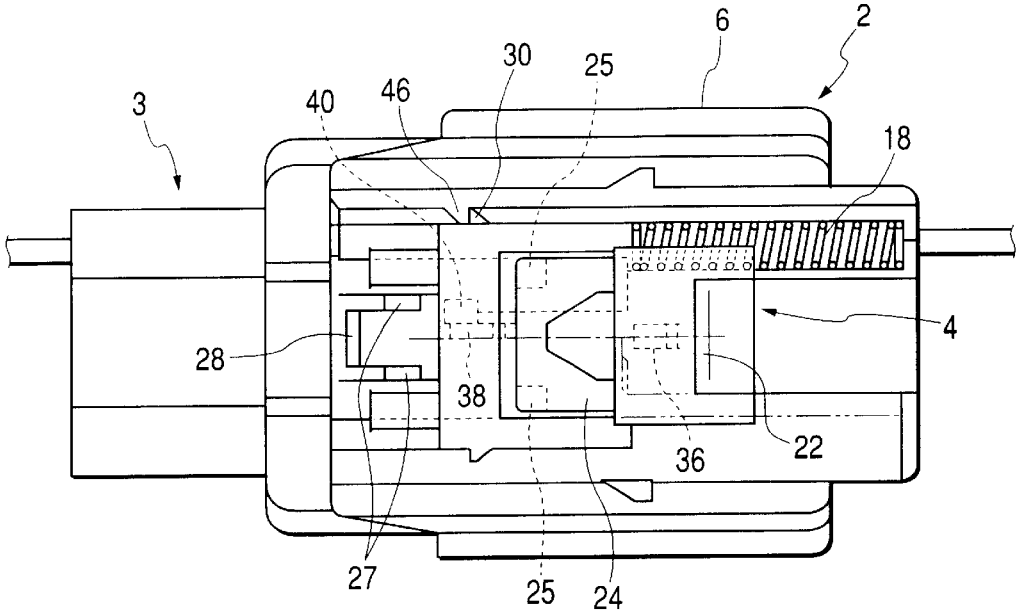
FIG. 11A is a plan view showing the connector in an initial state of coupling.
Figure 11B:
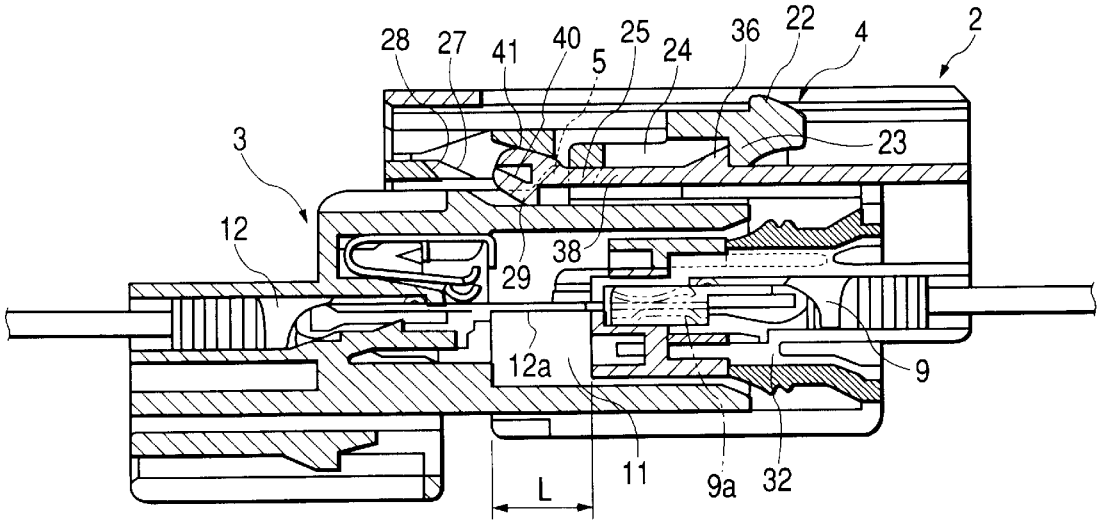
FIG. 11B is a sectional view of FIG. 11A.

In FIGS. 11A and 11B, when the male connector 2 and the female connector 3 are initially engaged with each other as the first step, the abutting projections 5 of the female connector 3 start to be abutted against the abutting projections 25 of the abutting arm 24 in the slider 4. In this state, the tab portions 12*a* of the male terminals 12 are not yet in contact with the electrical contact portions 9*a* of the male terminals 9, and there exists a large clearance L between a bottom of the connector engaging room 11 and a forward end of the inner housing 32.

Moreover, the slider 4 is in a state urged forward (in the engaging direction of the connector) by the helical springs 18. The helical springs 18 are remained pre-compressed, and are not deformed. Further, the stop projections 30 on both sides of the slider 4 are abutted against stop projections 46 of the male connector housing 6, and at the same time, the stop projection 23 on the backward side is abutted against the guide projection 36. A position of the forward end of the slider 4 is thus defined.

Figure 12A:
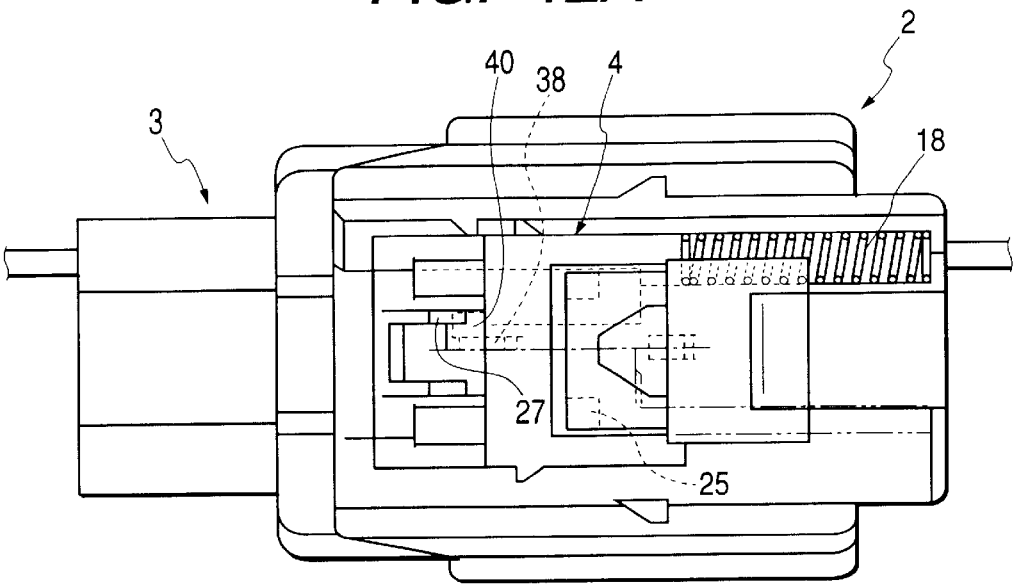
FIG. 12A is a plan view showing the connector in a state where the locking has started.
Figure 12B:
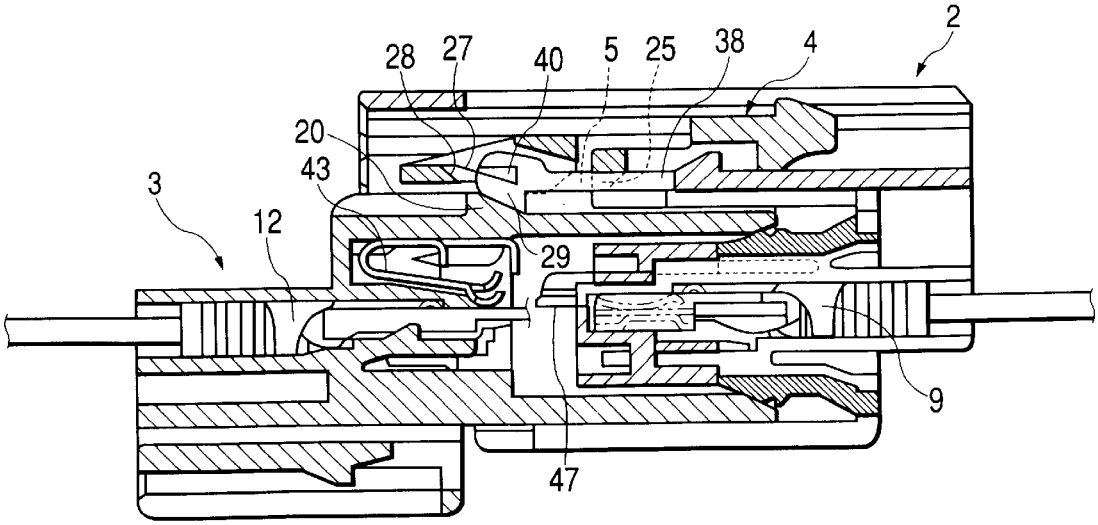
FIG. 12B is a sectional view of FIG. 12A.

Then, as the abutting projections 5 of the female connector 3 push the abutting projections 25 of the slider 4, as shown in FIGS. 12A and 12B, the slider 4 retreats while compressing the helical springs 18. On this occasion, the lock projection 20 of the female connector 3 is abutted against the lock projection 29 of the lock arm 38 in the male connector 2. At the same time, the first guide slopes 27 of the slider 4 come into contact with the contact projections 40 of the lock arm 38. Then, the contact projections 40 ascend along the first guide slopes 27, and accordingly, the lock arm 38 is flexed upwardly. At the same time, the male terminals 12 come into contact with the female terminals 9.

Figure 13A:
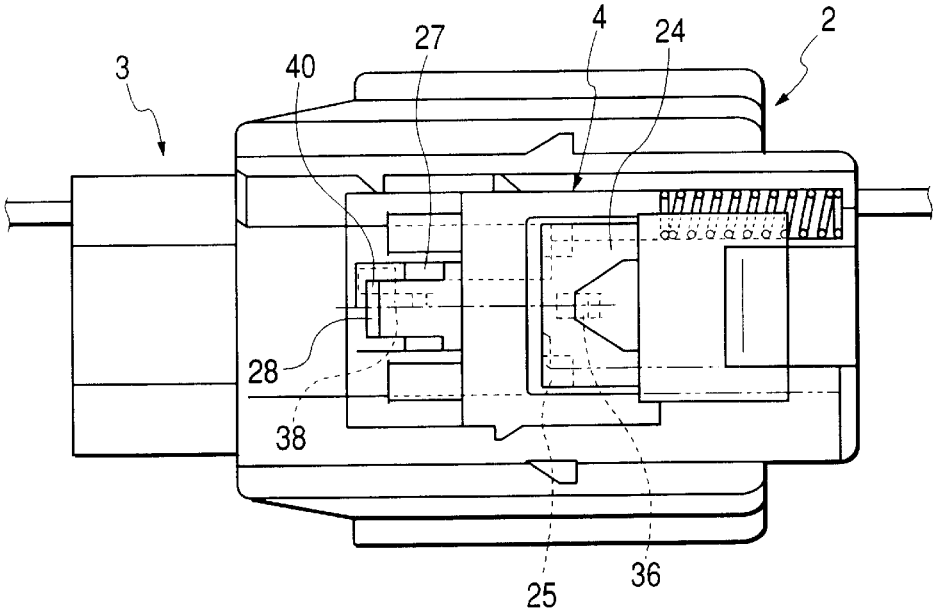
FIG. 13A is a plan view showing the connector in a state just before the locking.
Figure 13B:
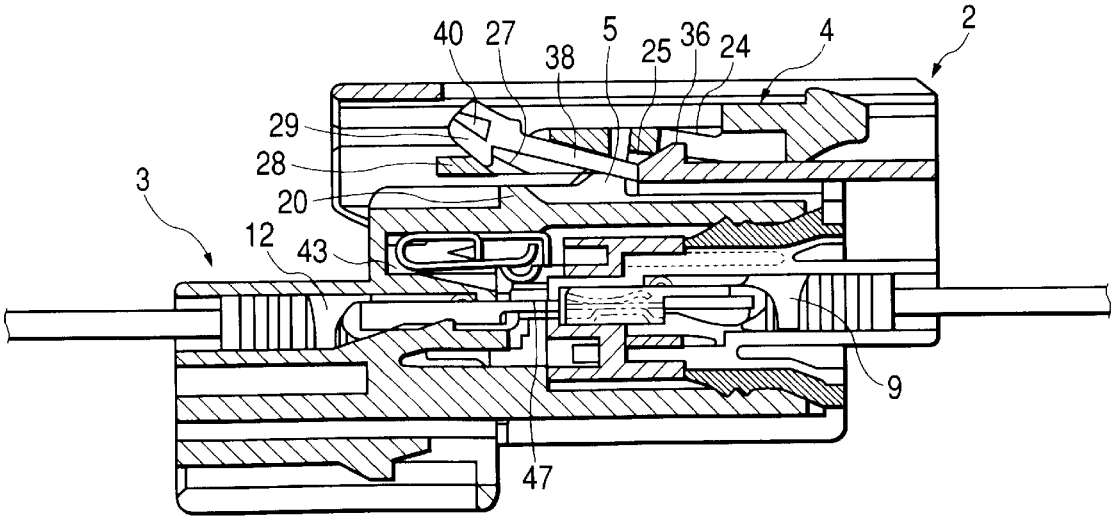
FIG. 13B is a sectional view of FIG. 13A.

As the next step, when the slider 4 has retreated as shown in FIGS. 13A and 13B, the lock projection 20 of the lock arm 38 slides along the second guide slope 28 upwardly to further flex the lock arm 38 in an upward direction. Then, the lock projection 29 of the lock arm 38 will pass over an upper face of the lock projection 20 of the female connector 3 to be positioned at a diagonally upward position forward of the lock projection 20.

When the contact projections 40 ascend along the first guide slopes 27, the lock projection 29 comes into contact with the second guide slope 28. With this movement, the lock arm 38 is largely flexed in two stages. When the abutting projections 25 of the slider 4 slide along the guide projection 36 of the male connector 2, the abutting arm 24 is accordingly flexed upwardly, and thus, the contact between the abutting projections 25 and the abutting projections 5 of the female connector 3 will be disengaged.

Figure 14:
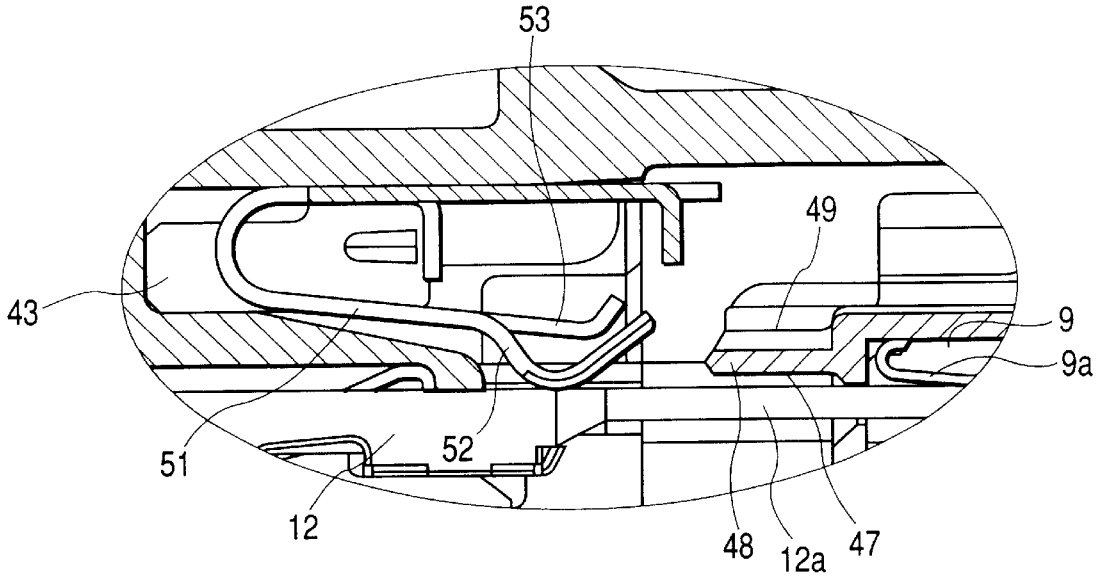
FIG. 14 is an enlarged sectional view of an essential part showing a state in which a short circuit has been established between male terminals.
Figure 15:
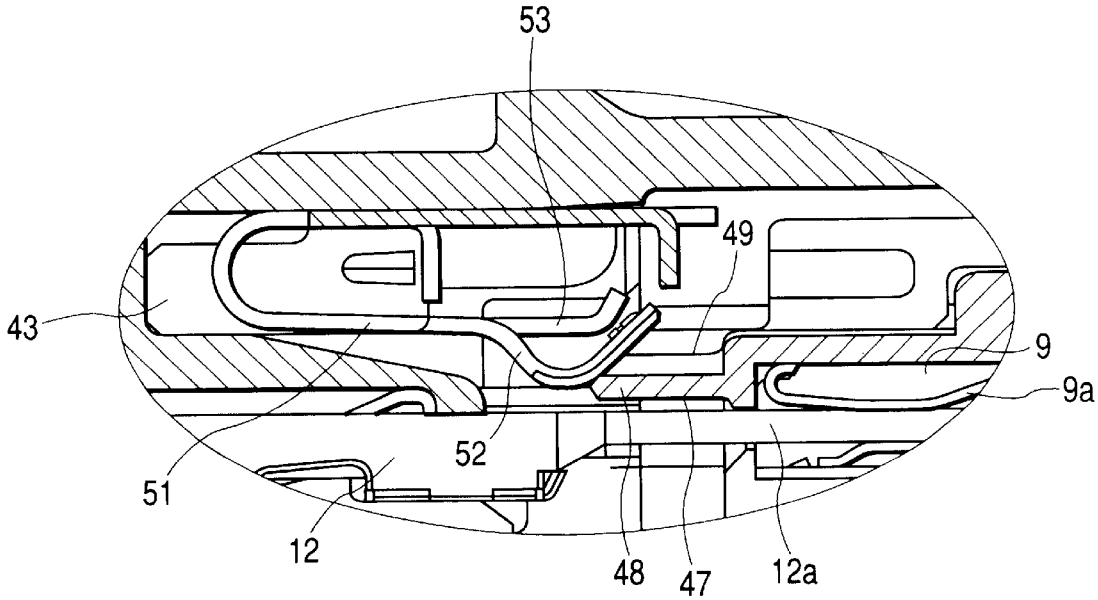
FIG. 15 is an enlarged sectional view of an essential part in a state in which the short circuit between the male terminals is being canceled.
Figure 16:
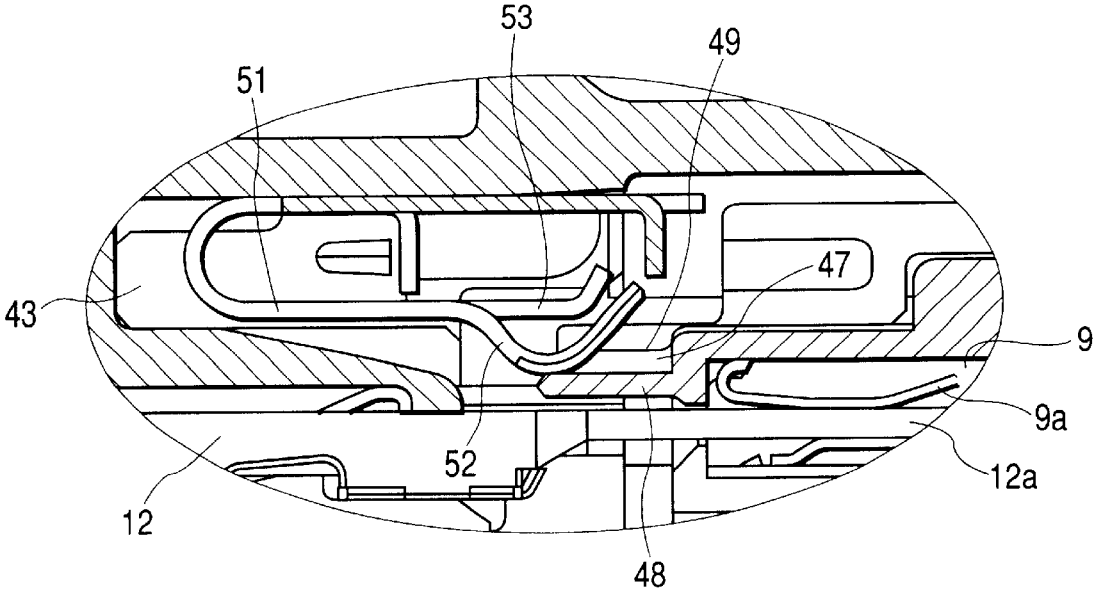
FIG. 16 is an enlarged sectional view of the essential part in a state in which the short circuit between the male terminals has been completely canceled.

In the state as shown in FIGS. 13A and 13B, both the connectors 2 and 3 have been perfectly coupled (plenary engagement) with no clearance, and both the terminals 9 and 12 have been in perfect contact with each other. Just before the plenary engagement, the insulating piece 47 approaches near the elastic arms 51 of the short-circuiting metal piece 43 which has short-circuited the male terminals 12, as shown in FIG. 14. When the insulating piece 47 and the elastic arms 51 have come into contact with each other as shown in FIG. 15, the short circuit cancellers 48 of the insulating piece 47 push the short-circuiting pieces 52 of the elastic arms 51 upward thereby to cancel the short circuit as shown in FIG. 16. The auxiliary pieces 53 of the elastic arms 51 move upward together with the short-circuiting pieces 52, and the auxiliary cancellers 49 of the insulating piece 47 enter under the auxiliary pieces 53.

Even though the short circuit cancellers 48 of the insulating piece 47 have happened to be deformed or broken due to some factor, the auxiliary cancellers 49 of the insulating piece 47 come into contact with the auxiliary pieces 53 of the elastic arms 51 to push them up, thereby to cancel the short circuit between the short-circuiting pieces 52 which move upward together with the auxiliary pieces 53 and the male terminals 12, so that reliability in electrical detection of the coupling will be enhanced.

Figure 17A:
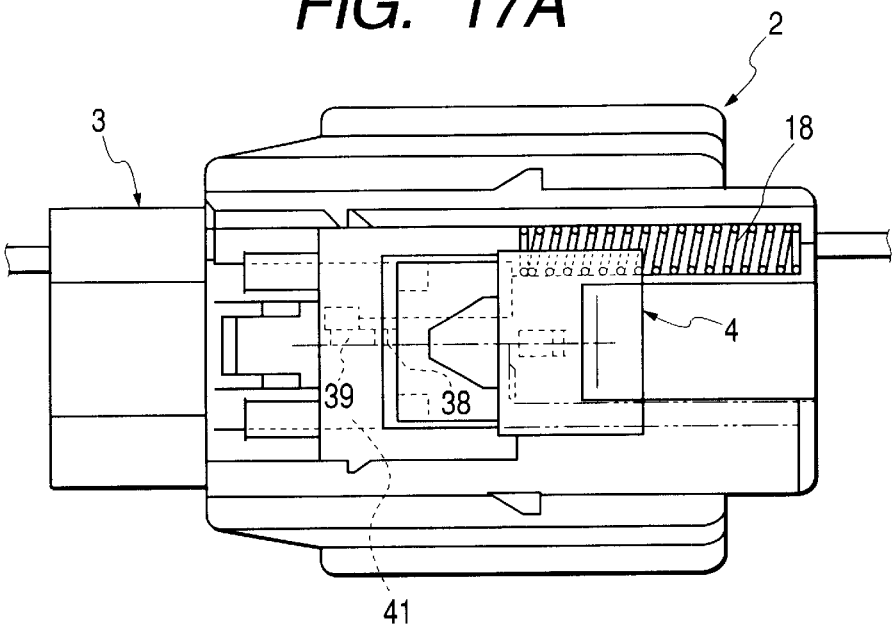
FIG. 17A is a plan view showing the connector in a completely coupled state.
Figure 17B:
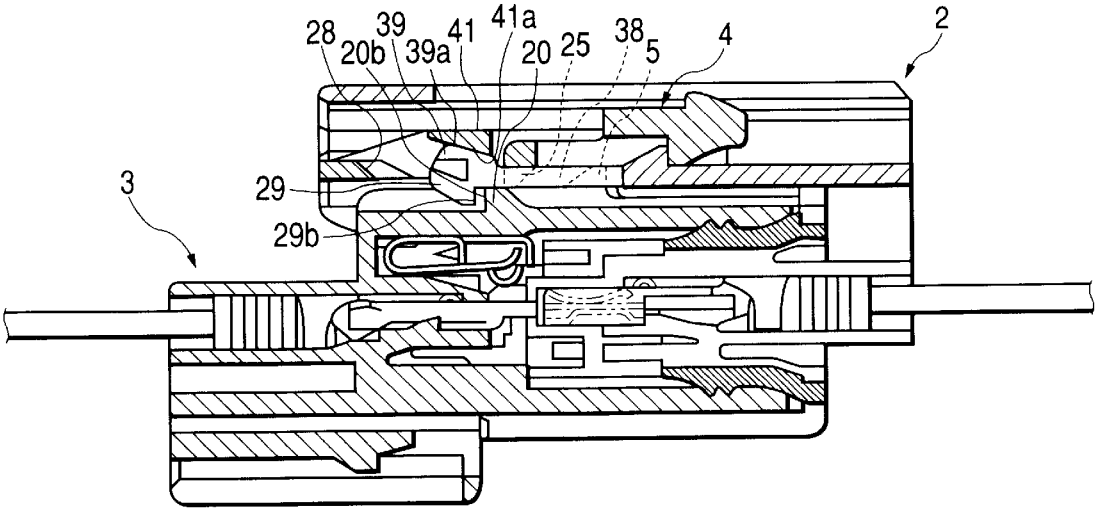
FIG. 17B is a sectional view of FIG. 17A.

Further in succession as shown in FIGS. 17A and 17B, when the contacts between both the abutting projections 5 and 26 have been disengaged, and the slider 4 has been pushed back forward by biasing forces of the helical springs 18, the initial state as shown in FIG. 4 will be restored. On this occasion, the abutting projections 25 of the slider 4 ride over the abutting projections 5 of the male connector 3, and move forward. At the same time, as the second guide slope 28 moves forward integrally with the slider 4, the contact between the lock projection 29 of the lock arm 38 and the second guide slope 28 will be disengaged, and the lock arm 38 will be elastically restored into a horizontal direction, allowing the lock projection 29 to be locked with the lock projection 20 in the female connector 3. In short, respective locking faces 20*b*, 29*b* of both the lock projections 29 and 20 come into contact with each other in an opposed relation, and thus, both the connectors 2 and 3 are locked to each other.

When the abutting wall 41 of the slider 4 is abutted against the inclined face 39*a* in the upper part of the abutting projection 39, flexure of the lock arm 38 will be restrained. Particularly, when the backwardly and downwardly inclined faces 39*a*, 41*a* respectively of the abutting wall 41 and the abutting projection 39 have securely come into contact with no clearance, unintentional disengagement of the lock will be reliably prevented. This is only because the slider 4 is urged forward by the helical springs 18, and with the urging force, the inclined face 41*a* of the abutting wall 41 is pressed against the inclined face 39*a* of the abutting projection 39.

By the way, in case where an operator has stopped to couple the connectors, on a half way of coupling the connector 1 as shown in FIGS. 12A and 12B, the female connector 3 is pushed out from the Male connector 2 by compression forces of the helical springs 18, since the abutting projections 25 of the slider 4 are in contact with the abutting projections 5 of the female connector 3. In this manner, an incomplete coupling of the connector 1 will be detected. The situation is also the same in the state of FIGS. 13A and 13B in which the lock is not yet completed. The situation is also the same in the process as shown in FIGS. 12A through 13B. In case where the operator has interrupted the coupling, the incomplete coupling of the connector 1 will be electrically detected similarly, because the short circuit between the male terminals 12 has not been cancelled.

Further, because the lock arm 38 is lifted along the first guide slopes 27 in the process in FIGS. 12A through 13B, allowing the contact between both the lock projections 20 and 29 to be disengaged, frictional resistance will be decreased, and the female connector 3 will be smoothly and reliably pushed out by the forces of the helical springs 18.

Figure 18A:
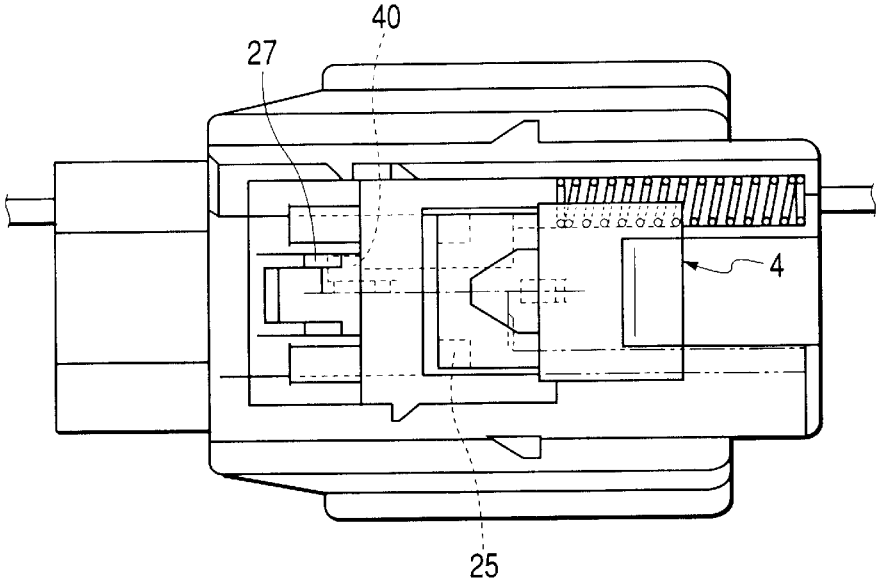
FIG. 18A is a plan view showing the connector in a state where cancellation of the lock has started.
Figure 18B:
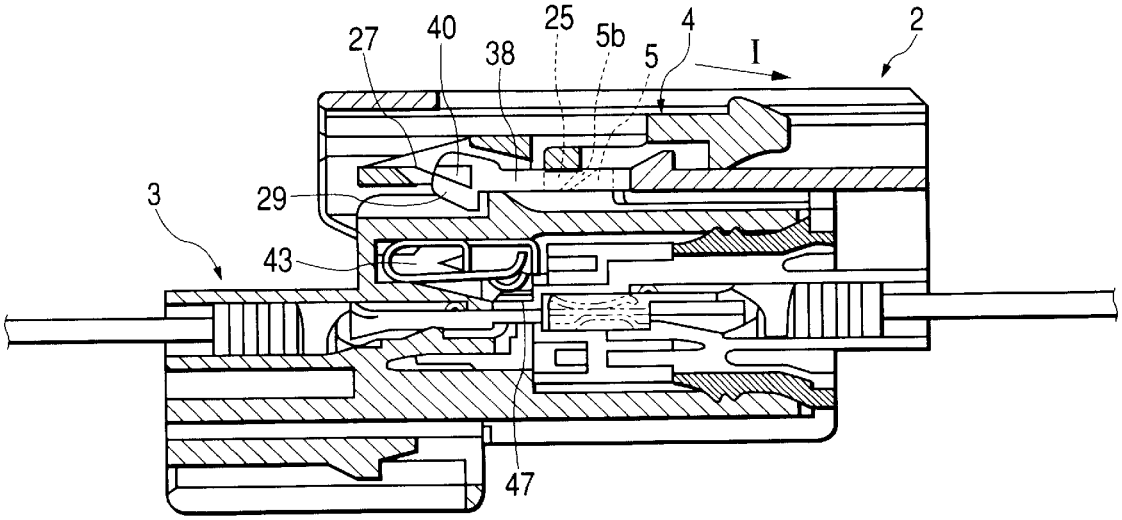
FIG. 18B is a sectional view of FIG. 18A.

Now, disengagement of the connectors 2 and 3 from the coupled state of the connector in FIGS. 17A and 17B will be explained. When the slider 4 is allowed to retreat by pulling the operating protrusion 22 of the slider 4 backward (in a disengaging direction of the connector) by a finger in a direction of an arrow 1, as shown in FIGS. 18A and 18B, the first guide slopes 27 of the slider 4 slide along the contact projections 40 of the lock arm 38. At the same time, the inclined faces 25*b* on the backward side of the abutting projections 25 of the slider 4 slide along the backwardly inclined faces 5*b* of the abutting projections 6 of the female connector 3.

Figure 19A:
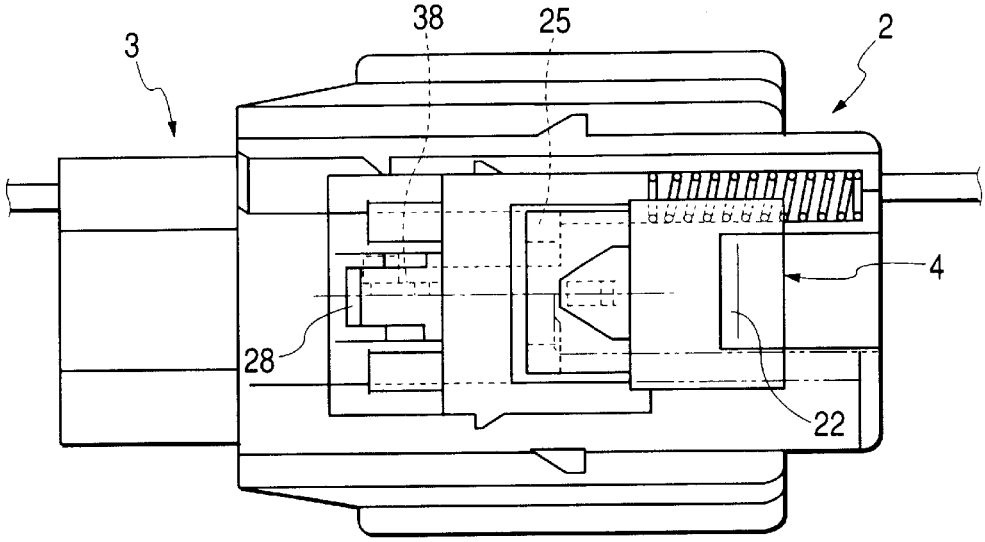
FIG. 19A is a plan view showing the connector in a state where the lock has been cancelled.
Figure 19B:
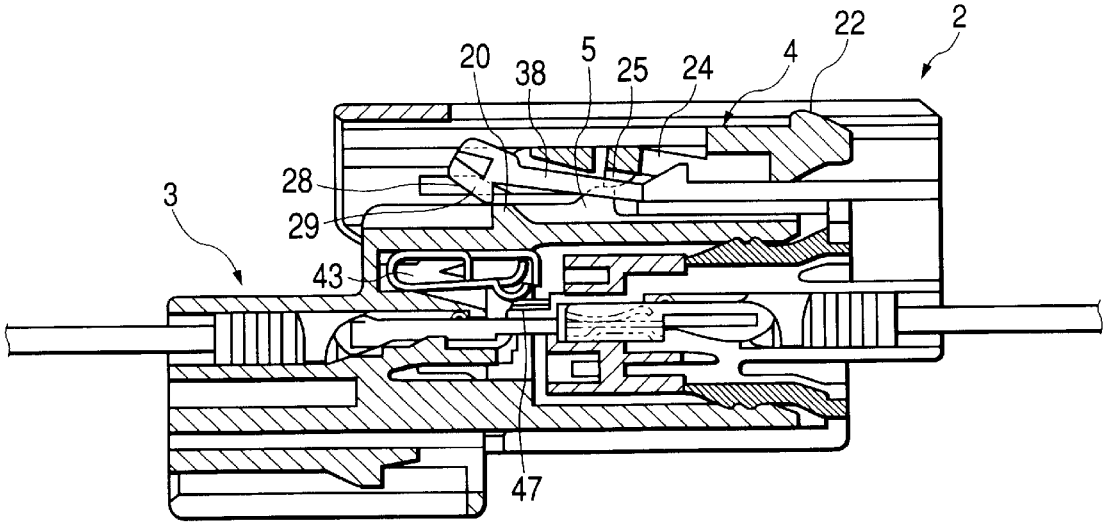
FIG. 19B is a sectional view of FIG. 19A.

Then, when the lock projection 29 of the lock arm 38 is pushed upward by the second guide slope 28 of the slider 4 as shown in FIGS. 19A and 19B, the lock arm 38 will be largely flexed upward, and the abutting projections 25 of the abutting arm 24 will ride over the abutting projections 5 of the female connector 3. Both the tock projections 20 and 29 will move apart in a vertical direction, and thus, the connectors 2 and 3 will be disengaged from the locked state. The operating protrusion 22 of the slider 4 remains pulled backward by the finger.

Figure 20A:
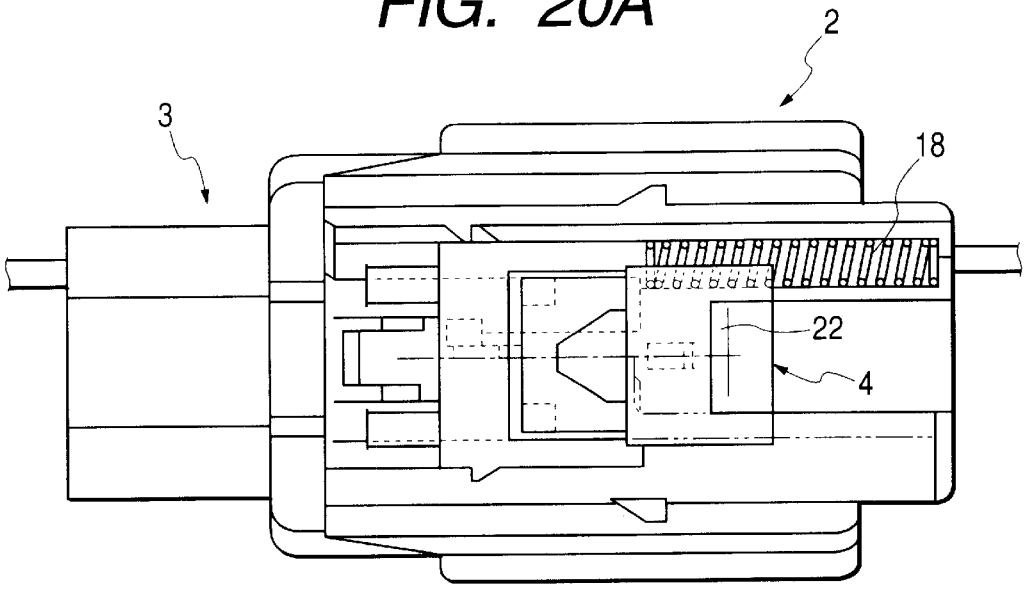
FIG. 20A is a plan view showing the connector in a disengaged state.
Figure 20B:
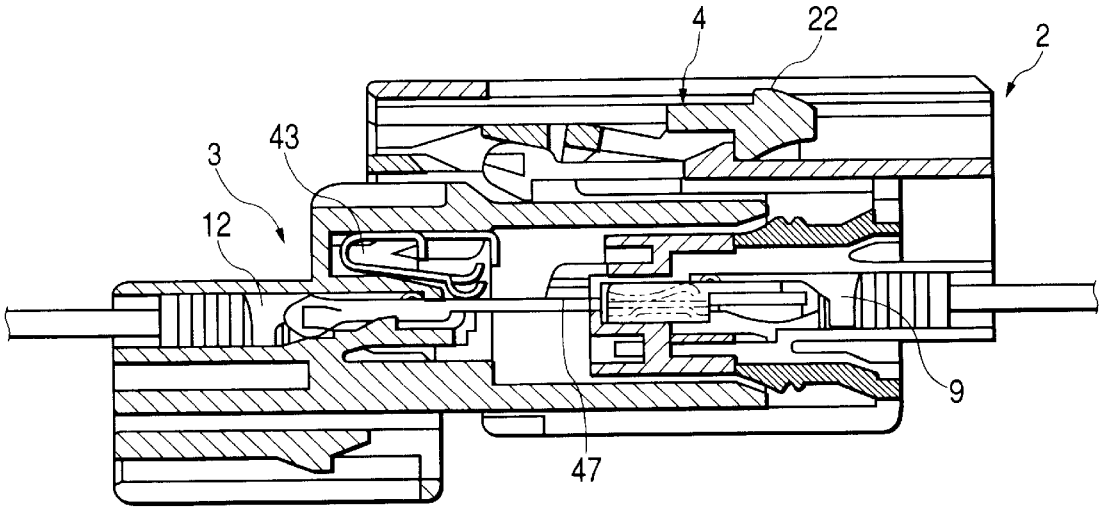
FIG. 20B is a sectional view of FIG. 20A.
Figure 21:
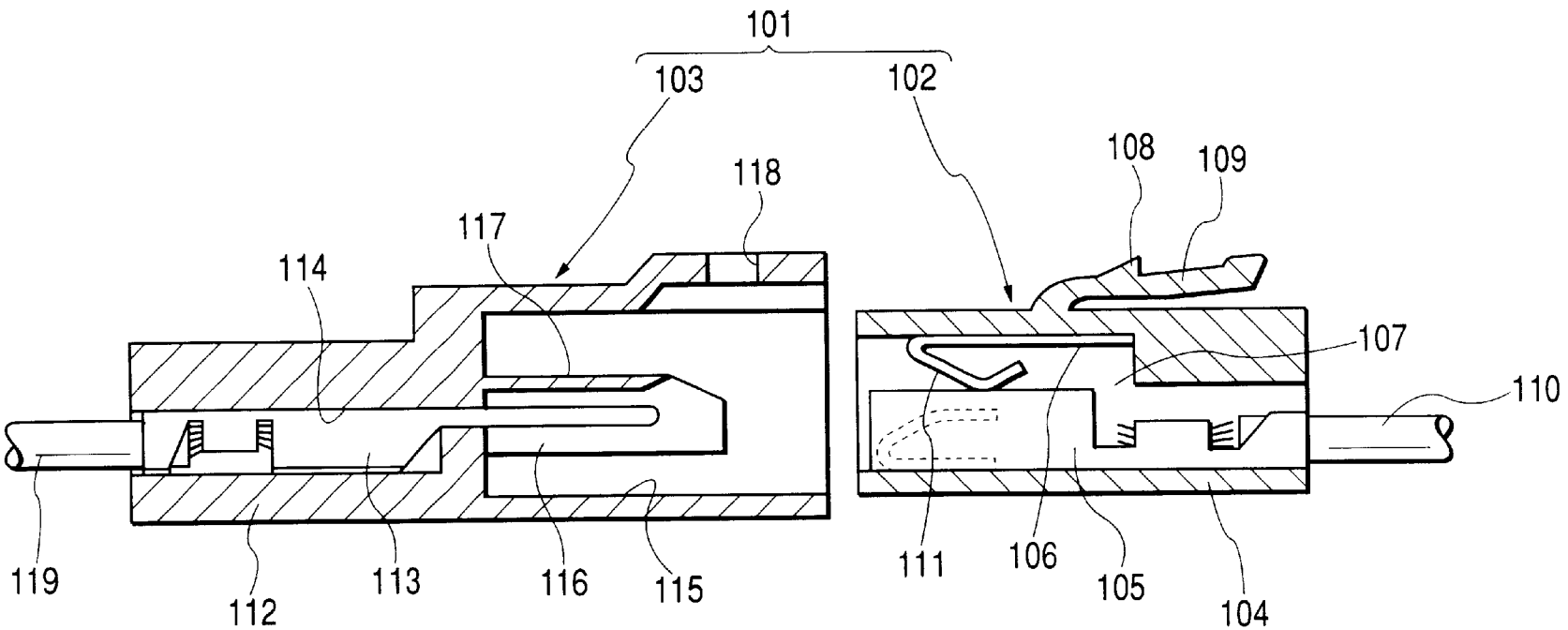
FIG. 21 is a sectional view of a connector provided with a related coupling detector.
Figure 22:
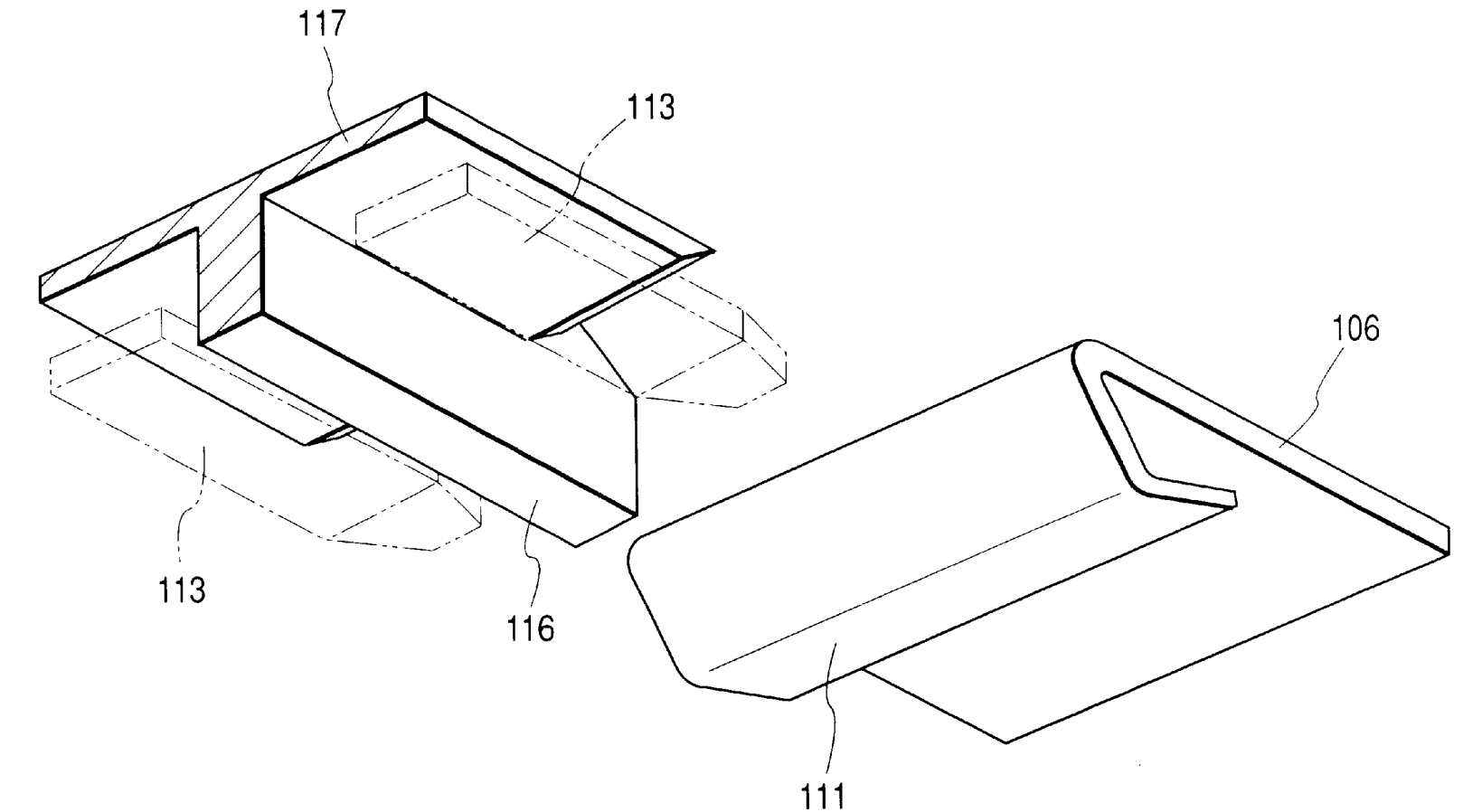
FIG. 22 is a perspective view of an essential part of the related coupling detector.
Figure 23:
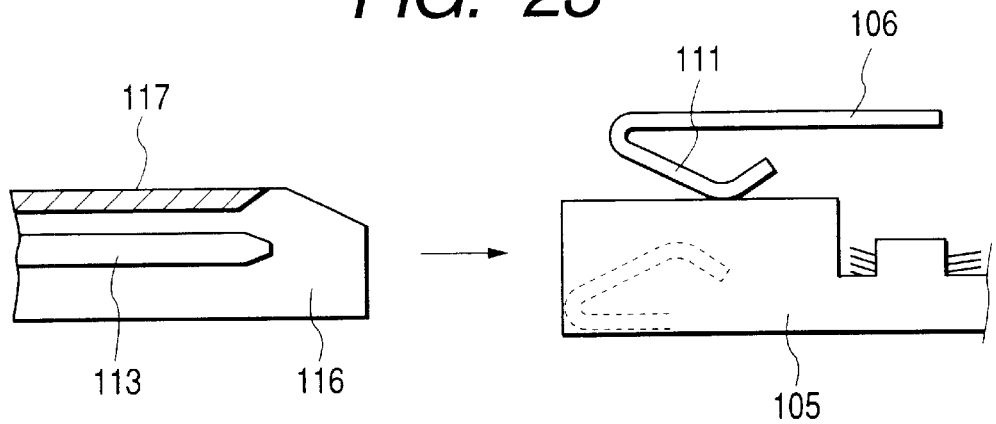
FIG. 23 is an explanatory view showing an essential part of the related coupling detector in an initial state of coupling.
Figure 24:
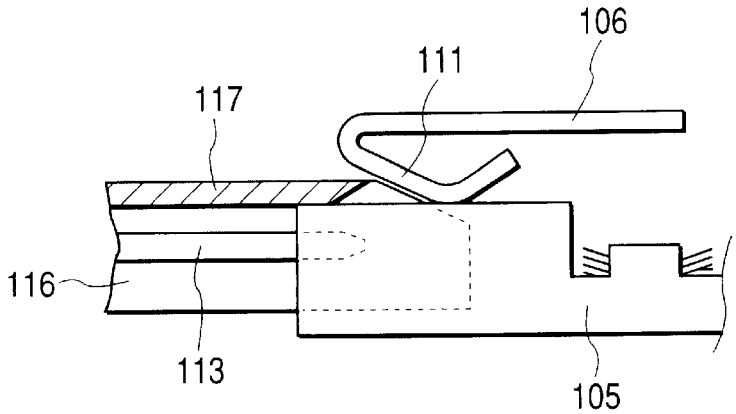
FIG. 24 is an explanatory view showing the essential part of the related coupling detector in a state on the way of the coupling.
Figure 25:
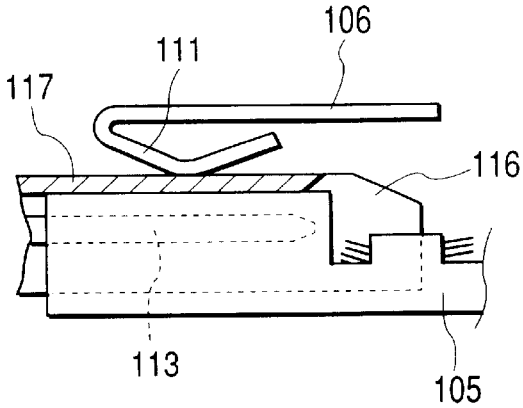
FIG. 25 is an explanatory view showing the essential part of the related coupling detector in a completely coupled state.

Then, by pulling both the connectors 2 and 3 in the disengaging direction as shown in FIGS. 20A and 20B, the connectors 2 and 3 will be disengaged from each other, and the connection between both the terminals 9 and 12 will be disengaged. The slider 4 will be restored to the forward position by the urging forces of the helical springs 18, when the finger is disengaged from the protrusion 22. The insulating piece 47 is also disengaged, allowing the short-circuiting metal piece 43 to establish the short circuit between the male terminals 12.

Besides, it is apparent that various modifications of the present invention can be made in a scope where a gist of the present invention is not changed.

What is claimed is:

1. A coupling detector for electrically detecting whether a first connector and a second connector are plenarily coupled with each other, comprising:

a conductive member provided in the first connector together with a plurality of terminal fittings, the conductive member including elastic arms associated with the respective terminal fittings, each elastic arm being divided into a first conductive piece and a second conductive piece which are moved together, the first conductive piece brought into contact with the terminal fitting when the first connector and the second connector are disengaged, the second conductive piece being away from the terminal fitting when the first connector and the second connector are disengaged; and insulative members provided in the second connector so as to be associated with the respective elastic arms, each insulative member including a first insulative piece and a second insulative piece, the first insulative piece inserted between the terminal fitting and the first conductive piece when the first connector and the second connector are engaged, the second insulative piece moving the second conductive piece in a direction away from the terminal fitting when the first connector and the second connector are engaged.

* * * * *